US006618959B1

(12) United States Patent
Sussmann

(10) Patent No.: US 6,618,959 B1
(45) Date of Patent: Sep. 16, 2003

(54) CUSHIONING INSERT FOR A SHOE AND SHOE THAT IS PROVIDED WITH SUCH A CUSHIONING INSERT

(75) Inventor: Reinhold Sussmann, Scheinfeld (DE)

(73) Assignee: PUMA AG Rudolf Dassler Sport, Herzogenaurach (DE)

( * ) Notice: Subject to any disclaimer, the term of this patent is extended or adjusted under 35 U.S.C. 154(b) by 0 days.

(21) Appl. No.: 09/959,700

(22) PCT Filed: Apr. 12, 2000

(86) PCT No.: PCT/DE00/01194

§ 371 (c)(1),
(2), (4) Date: Nov. 5, 2001

(87) PCT Pub. No.: WO00/65945

PCT Pub. Date: Nov. 9, 2000

(30) Foreign Application Priority Data

May 3, 1999 (DE) ..... 299 07 844 U

(51) Int. Cl.[7] ..... A43B 13/20; A43B 23/08

(52) U.S. Cl. ..... 36/29; 36/69; 36/93; 36/35 B; 36/43

(58) Field of Search ..... 36/92, 93, 29, 36/35 B, 69, 43, 44

(56) References Cited

U.S. PATENT DOCUMENTS 532,429 A * 1/1895 Rogers ..... 36/43
2,150,057 A * 3/1939 Fisch ..... 36/29
2,433,329 A * 12/1947 Adler et al. ..... 36/44
4,808,469 A * 2/1989 Hiles ..... 36/44
4,878,301 A * 11/1989 Kiyosawa ..... 36/69
5,174,049 A * 12/1992 Flemming ..... 36/28
5,718,063 A * 2/1998 Yamashita et al. ..... 36/29
5,830,553 A * 11/1998 Huang ..... 36/29
D403,847 S * 1/1999 Blythe ..... D2/961
5,918,383 A * 7/1999 Chee ..... 36/35 B

FOREIGN PATENT DOCUMENTS

EP 526892 * 2/1993
GB 2150010 * 6/1985

* cited by examiner

*Primary Examiner*—Ted Kavanaugh
(74) *Attorney, Agent, or Firm*—Nixon Peabody LLP; David S. Safran

(57) ABSTRACT

A cushioning insert (1) to be inserted in the heel zone of a shoe is provided with a honey-comb structure (2) which is improved in such a manner that it provides good cushioning properties and sufficiently supports the heel even if the outsoles or soles (16) of the shoe are relatively thin. To this end, the cushioning insert (1) is made of a structural unit that includes heel shell (3) and a gas-tight honey-comb structure that is provided on the upper side (7.1) or the lower side (10) of the shell bottom (7) of the heel shell (3).

29 Claims, 2 Drawing Sheets

FIG. 1
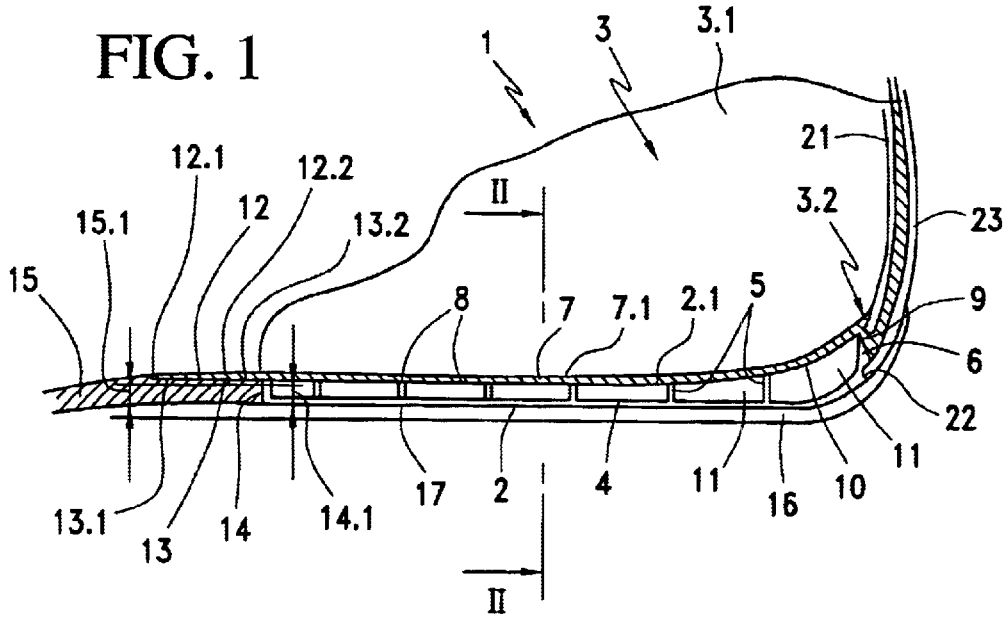
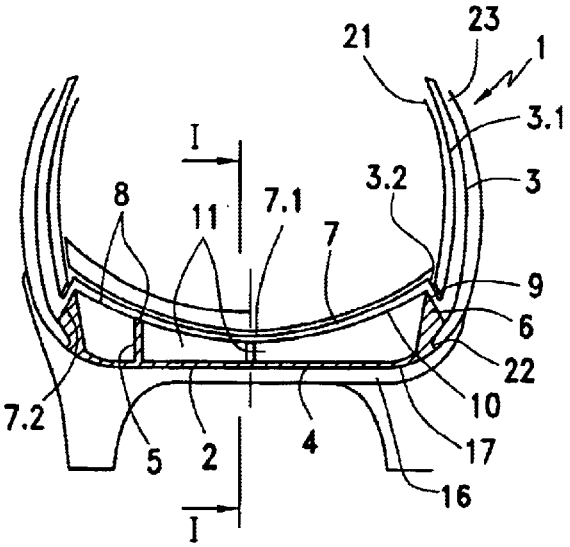
FIG. 2
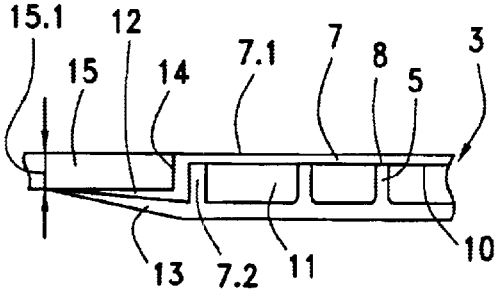
FIG. 4
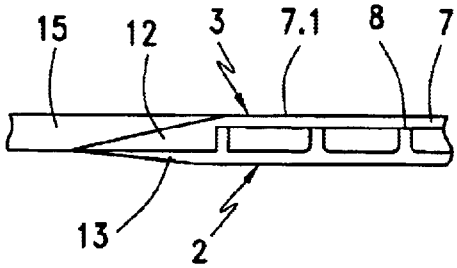
FIG. 5
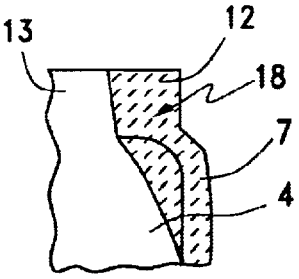
FIG. 3
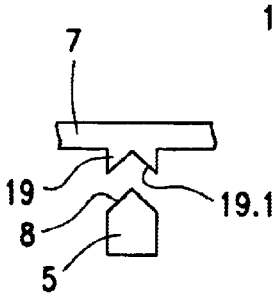
FIG. 6
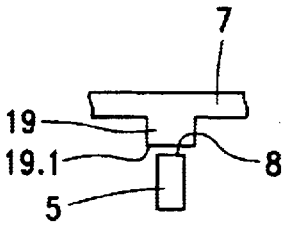
FIG. 7

FIG. 8
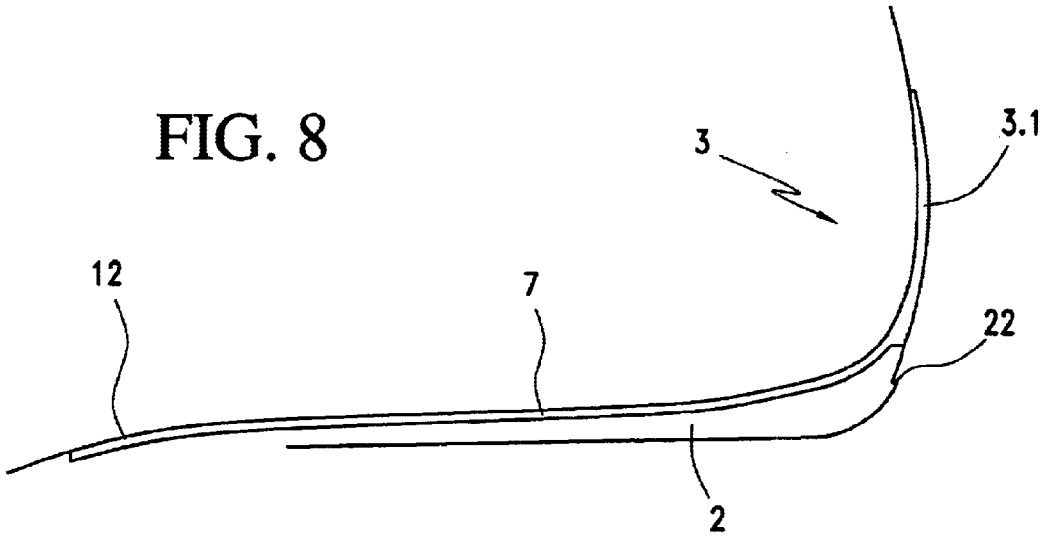
FIG. 9
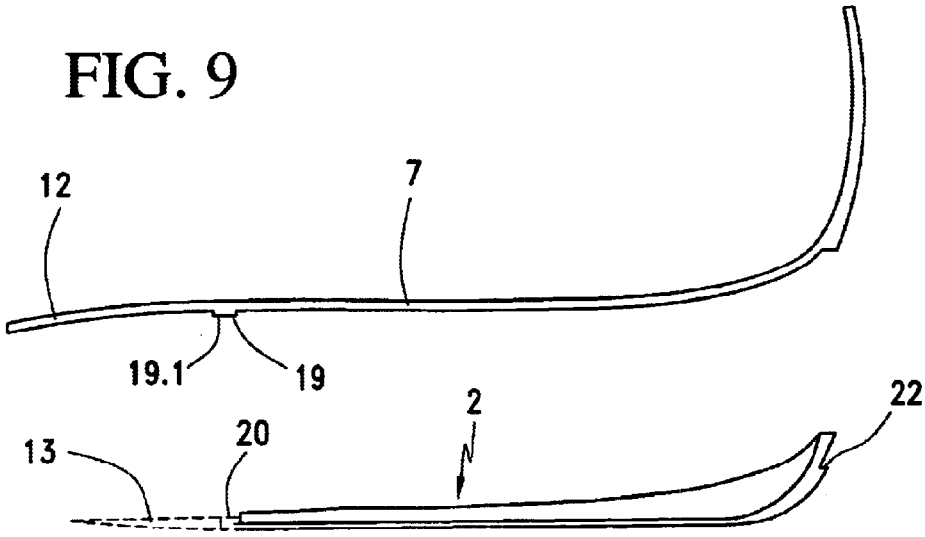
FIG. 10
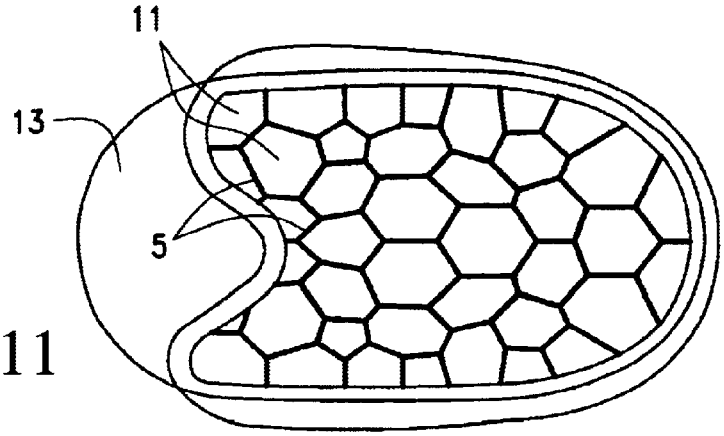
FIG. 11

CUSHIONING INSERT FOR A SHOE AND SHOE THAT IS PROVIDED WITH SUCH A CUSHIONING INSERT

BACKGROUND OF THE INVENTION

1. Field of the Invention

This invention relates to a cushioning insert into the heel area of a shoe, especially an athletic shoe, such as a soccer shoe, which has a honeycomb body, and to a shoe with such a cushioning insert.

2. Description of Related Art

A cushioning insert of this type and a shoe with one such cushioning insert are known from the German utility model 89 01 236. There, a gastight honeycomb body of elastic compressible material is inserted into a depression in the heel area of a shoe, into a cavity of an outsole which is made spring-elastic or in a soft elastic through-sole of the sole of the shoe.

The honeycomb cells which are closed in the border area of the finished molded body clearly increase the restoration force in this area of the honeycomb body so that the inner area of the cushioning honeycomb body or the honeycomb body which produces the restoration forces is even softer than this border area.

Published German Patent Application DE 36 29 264 A1 discloses reducing the deep immersion of the heel into the heel cap by the tread surface which is surrounded by the heel cap having a pressure distribution membrane.

Furthermore, German Patent DE 39 24 360 C2 discloses providing in the heel area of an outsole a depression into which a coupling element can be inserted into which, in turn, a grip element which projects down can be interchangeably screwed from the outside. Above the coupling element there is an elastic cushioning element in the form of a honeycomb body. This elastic cushioning element is fixed in its position to the top by a relatively stiff cover plate. The grip element when treading along with the coupling element can dip into the depression through the inserted cushioning insert. In this way, when treading, cushioning is achieved without the heel being moved relative to the heel cap. But the thickness of the sole is relatively large since the cushioning insert and the coupling element are located on top of one another.

SUMMARY OF THE INVENTION

The object of this invention is to improve a cushioning insert of the initially mentioned type such that it ensures good cushioning properties even with relatively thin outsoles or shoe soles of hard elastic material, as can be encountered for example in soccer shoes, and good support of the heel is ensured.

This object is achieved by the cushioning insert being made of a structural unit composed of a heel shell and a gas-tight honeycomb body which is provided on the top or on the underside of the bottom of the heel shell or of a honeycomb cell body which is connected in a gas-tight manner to the heel shell, and by the bottom of the cushioning insert being matched to the contour of the top of the shoe sole and attached on it.

This invention ensures that no relative motion or only an insignificant amount of relative motion occurs between the heel and heel cap since the upper cover plate or the bottom of the heel shell can spring down. The upper cover plate therefore executes essentially the same motion as the heel cap, by which the heel is securely held in the shoe.

Other advantageous details of the invention will become apparent from the following detailed description of the preferred embodiments and the accompanying drawings.

BRIEF DESCRIPTION OF THE DRAWINGS

FIG. 1 shows a side view of a shoe section with a cushioning insert in accordance with the invention taken along line I—I of FIG. 2, FIG. 2 is a cross-sectional view of the shoe section shown in FIG. 1 taken along line II—II therein, FIG. 3 shows a bottom view of the tongue area of the cushioning insert, FIGS. 4 and 5 shows two versions of the execution of the tongue, FIGS. 6 and 7 each show one possible embodiment of honeycomb cell webs of one component and the associated ribs of this component, FIG. 8 schematically shows a combination of the heel shell with a honeycomb cell body in a side view, FIG. 9 shows an exploded view of the heel shell of FIG. 8, FIG. 10 shows the honeycomb cell body of FIG. 8, and FIG. 11 shows an overhead view of the cell structure of a honeycomb cell body.

DETAILED DESCRIPTION OF THE INVENTION

The cushioning insert 1 shown in FIGS. 1 and 2 is made as a structural unit composed of a honeycomb cell body 2 which is open on one side or of a gas-tight honeycomb body and a heel shell 3. Honeycomb webs 5 which project up and a peripheral border 6 which runs in or roughly in the direction of the honeycomb webs 5 are molded onto the bottom 4 of the honeycomb cell body 2. The honeycomb cell body 2 is formed of a molded part made of an elastic resilient material with a hardness of roughly 60 to 92 Shore A, especially of roughly 70 to 80 Shore A. Especially thermoplastic polyurethane is suited as the material.

The honeycomb cell body 2 is attached from underneath to the bottom 7 of the heel shell 3, the edges 8 of the honeycomb webs 5 and the edge 9 of the peripheral border 6 adjoining the underside 10 of the shell bottom 7. The web edges 8 and the edge 9 of the border 6 are joined in a gas-tight manner to the shell bottom 7 by suitable means, for example, by an adhesive connection and/or by an ultrasonic connection and/or by a weld. In this way, gas-tight honeycomb cells 11 are formed.

The heel shell 3 can be made of a material which has the same properties as those of the honeycomb cell body 2. But preferably, the material of the heel shell 3 has a hardness which is greater than that of the honeycomb cell body 2 and varies roughly between 60, preferably between 65, and 90 Shore A. For the heel shell 3, preferably thermoplastic polyurethane or polyamide is used as the material.

The superficial extent of the honeycomb cell body 2 corresponds to that or almost that of the shell bottom 7. Both parts extend preferably into the area of the arch of the foot, the heel shell 3 and/or the honeycomb cell body 2 there passing into a tongue 12 and 13 which is thin in cross section. One or both tongues 12, 13 are advantageously made wedge-shaped or roughly wedge-shaped and run angularly to their end 12.1 and 13.1. Here, the respective top 12.2 and 13.2 runs in the same plane as the top 7.1 of the shell bottom 7 or as the virtual top 2.1 of the honeycomb cell body 2. Preferably, at the start of the tongue 13, there is a step 14 with a height 14.1 which corresponds to the thickness 15.1 of the insole 15 of a corresponding shoe.

Without diverging from the inventive idea, instead of the honeycomb cell body 2, there can be a gas-tight honeycomb body. This gas-tight honeycomb body can be attached to the underside 10 or the top 7.1 of the shell bottom 7. Furthermore, the honeycomb body can be formed of the honeycomb cell body 2 with a cover plate applied to its virtual top 2.1 in a gas-tight manner, or if the honeycomb webs 5 and the border 6 point down, then accordingly to its bottom. The honeycomb body or the honeycomb cell body 2 can be attached on the top 7.1 of the shell bottom 7. The honeycomb cell body 2 which is not provided with a cover plate is then attached gas-tight on the top 7.1 of the shell bottom 7 with the honeycomb webs 5 and the border 6 pointed down. For a honeycomb cell body 2 which is closed by the cover plate, the latter can be made of the same material as of the honeycomb cell body 2. But, it can also be made of a harder and more inelastic material.

Especially when, the honeycomb cell body 2 is joined to the bottom 7 of the heel shell 3, the shell bottom 7 is made membrane-like and preferably elastically extensible.

According to one advantageous development of the invention, the heel shell 3 and/or the honeycomb body and/or the honeycomb cell body 2, and an optionally pertinent cover plate, are made of transparent or translucent material. In this case, the shoe sole 16 also is preferably made, at least in the area or roughly in the area of the shell bottom 7, at least in part, partially or in sections of transparent or translucent material.

The underside 7.1 of the shell bottom 7 is advantageously surrounded by a peripheral border 7.2 so that the shell bottom 7 is located somewhat recessed. When the honeycomb cell body or the honeycomb cell body 2 is inserted, its peripheral border 6 interacts with the border 7.2 so that the honeycomb body or honeycomb cell body 2 is fixed in position. The honeycomb body or the honeycomb cell body 2 and the heel shell 3 are joined securely to one another by means of cement or ultrasound along the borders 6 and 7.2.

The position can also be fixed via a depression which is provided in one component and via a border web which is provided on the other component, for example, the edge 9 of the border 6 of the honeycomb cell body 2, and cementing and/or ultrasonic welding. The depression and the border web can each be made in the manner of a tongue-in-groove joint. This applies to all connections between the components heel shell 3, the honeycomb body or the honeycomb cell body 2 and optionally the cover plate. For example, this connection takes place between the honeycomb body and the heel shell 3 or the bottom 4 of the honeycomb cell body 2 and the heel shell 3 or the cover plate of the honeycomb cell body 2 and the honeycomb cell body 2 or the cover plate of the honeycomb cell body 2 and the heel shell 3.

Advantageously, the tread surface of the honeycomb body or the honeycomb cell body 2 or its cover plate is matched to the profile of the heel in the manner of a trough.

The underside 17 of the cushioning insert 1, for example, the bottom 4 of the honeycomb body or the honeycomb cell body 2 or its cover plate or of the bottom 7 of the heel shell 3 is matched to the planar shape of the surface of a shoe sole 16 on which the cushioning insert 1 is placed and is connected to it. In the area of the tread by the heel, the bottom 17 of the cushioning insert 1 can be pulled flat and in the border area upward in an arc-shape.

As already mentioned, there can be tongues 12, 13 on the cushioning insert. In general, at least two of the components, heel shell 3, the top or bottom cover plate of a honeycomb cell body 2 and/or the honeycomb body, can have tongues which lie on top of one another and which are joined securely to one another, for example, by cementing or ultrasound.

Furthermore, it can be useful to make the lower tongue narrower than the overlying upper tongue. In this way, for example, the lateral surface 18 of the upper tongue or of the shell bottom 7, which lateral surface remains free by virtue of the narrower tongue, can be used for attaching the corresponding upper material of the shoe.

For example, in the cutout shown in FIG. 3 from underneath, the tongue can be composed of the upper tongue 12 of the heel shell 3 and the lower tongue 13 of the upper cover plate of the honeycomb cell body 2 or of the honeycomb cell body 2 itself. These parts lie on top of one another and are securely joined to one another, especially cemented or welded.

Preferably, the lower tongue 13 is narrower than the upper tongue 12. In this way, on both sides, a free surface 18 is formed; it is shown by the broken crosshatching and is used for cementing or otherwise attaching a correspondingly sized part of the upper material of the shoe.

One version of the execution of the tongue is shown in FIG. 4. Here, the tongues 12 and 13 are attached underneath by a step 14 which is provided at the top of the shell bottom 7 and the insole 15 rests on the upper tongue 13 and is, for example, cemented to it.

In the version shown in FIG. 5, the tongue 13 of the shell bottom 7 is made obliquely descending towards the end 12.1 as far as the lower tongue 13. The insole 15 which rests on this lower tongue 13 is made to run diametrically opposed, obliquely upward, so that a continuous transition results.

In order to obtain a good gas-tight connection between the honeycomb webs 3 and the cover plate or the shell bottom 7, according to FIGS. 6 and 7, the cover plate or the shell bottom 7 can have a system of ribs 19 which corresponds to the system of arrangement of the honeycomb webs 5, for example, of a honeycomb cell body 2. An especially good connection is obtained when the web edge 8 is made straight or roof-like and the edge 19.1 of the ribs 19 is made recessed in a V-shape, see FIG. 6 in this respect. In addition, a good connection can be obtained when the ribs 19 are wider than the honeycomb webs 5. Then, the edge 19.1 which runs perpendicular to the direction of the honeycomb webs 5 can also run flat and also the edges 8 of the honeycomb webs 5 can be made flat, compare FIG. 7 in this respect.

FIG. 8 schematically shows a heel shell 3 with a tongue 12 and a honeycomb cell body 2 attached underneath, from the side.

FIG. 9 also shows that, at the start of the tongue 12, there is a rib 19 via which the section 20 of the honeycomb cell body 2 shown in FIG. 10 can be effectively and securely joined, as was explained above using FIGS. 6 and 7 for the honeycomb webs 5.

FIG. 11 shows an overhead view of a honeycomb cell body 2 or a gas-tight honeycomb body with the cover plate removed.

It should be mentioned that the edge of an inner lining 21 is placed in or on the border 3.2. Furthermore, using especially FIGS. 1, 8 and 10, the peripheral support edge 22 can be recognized. It is placed against the edge of the upper material of the shoe.

The cushioning insert 1 according to the invention with its bottom 17 which is matched to the contour of the top of the outsole 16, therefore the bottom of the cover plate or of the shell bottom 7, is inserted into the heel area of a shoe and is securely connected to it, for example, cemented in and/or sewn in. The existing insole 15 extends as far as the step 14 and lies under the tongue 13 (FIG. 1) or it lies on the tongue 12 (FIG. 4) or it is continuously matched (FIG. 5). The insole 15 is permanently joined to the tongue 12 and 13, especially cemented.

What is claimed is:

1. Cushioning insert for insertion into the heel area of a shoe, comprising a structural unit composed of a honeycomb body and a heel shell with a upwardly projecting peripheral heel cap for connection to a shoe upper, the heel cap being formed of one piece with the heel shell as a part thereof, and wherein the honeycomb body is closed in a gas-tight manner by a portion of the heel shell.

2. Cushioning insert as claimed in claim 1, wherein the area of the honeycomb body is substantially equal to that of the bottom of the heel shell.

3. Cushioning insert as claimed in claim 1, wherein the honeycomb body extends into an area of the arch of a wearer's foot, in which area at least one of the honeycomb body and the heel shell is formed with a thin tongue.

4. Cushioning insert as claimed in claims 3, wherein the tongue is at least roughly wedge-shaped in cross section and runs angularly to an end of the tongue.

5. Cushioning insert as claimed in claim 3, wherein a surface of the tongue on one of the honeycomb body and the heel shell runs in the same plane a surface of the other of the honeycomb body and the heel shell.

6. Cushioning insert as claimed in claim 3, wherein the tongue is formed on the honeycomb body, and wherein a transition from a surface of a cushioning part of the honeycomb body to the tongue forms a step with a height which corresponds at least roughly to a thickness of an insole of a shoe to be received therein in use.

7. Cushioning insert as claimed in claim 1, wherein the honeycomb cell body is a molded part of elastically resilient material which has a bottom with honeycomb webs molded to it and a peripheral border which runs in roughly in a direction of the honeycomb webs, and wherein the honeycomb webs and the border are joined in a gas-tight manner to the heel shell.

8. Cushioning insert as claimed in claim 7, wherein honeycomb webs and the border are joined to the heel shell by means of one of a cement, ultrasound, and a weld.

9. Cushioning insert as claimed in claim 7, wherein when the honeycomb webs and the border are joined to a bottom of the heel shell which is elastically extensible in the manner of a membrane.

10. Cushioning insert as claimed in claim 7, wherein an outer side of the honeycomb body and a border of the heel shell are securely connected to one another via a peripheral depression in one of the honeycomb body and the heel shell and a peripheral border web in the other of the honeycomb body and the heel shell in the manner of a tongue-in-groove joint.

11. Cushioning insert as claimed in claim 1, wherein the honeycomb body is formed of an elastically extensible, resilient material with a hardness of roughly 60 to 92 Shore A.

12. Cushioning insert as claimed in claim 1, wherein the honeycomb body is formed of an elastically extensible, resilient material with a hardness of roughly especially of roughly 70 to 80 Shore A.

13. Cushioning insert as claimed in claim 1, wherein the heel shell is formed of a material with a hardness of roughly 60 to 98 Shore A.

14. Cushioning insert as claimed in claim 13, wherein the heel shell is made of a thermoplastic polyurethane or polyamide.

15. Cushioning insert as claimed in claim 14, herein the honeycomb body is made of thermoplastic polyurethane.

16. Cushioning insert as claimed in claim 14, wherein the heel shell is made of a transparent or translucent material.

17. Cushioning insert as claimed in claim 16, wherein the honeycomb body is made of transparent or translucent material.

18. Cushioning insert as claimed in claim 1, wherein the heel shell is formed of a material with a hardness of 65 to 90 Shore A.

19. Cushioning insert as claimed in claim 1, wherein the honeycomb body and the heel shell are securely connected to one another via a peripheral depression in one of the honeycomb body and the heel shell and a peripheral border web in the other of the honeycomb body and the heel shell in the manner of a tongue-in-groove joint.

20. Cushioning insert as claimed in claim 1, wherein a tread surface of one of the honeycomb body and the heel shell is provided on top with a trough-shaped heel-receiving profile.

21. Cushioning insert as claimed in claim 1, wherein a bottom side of one of the honeycomb body and the heel shell has a planar shape for matching a surface of shoe sole into which it is to be inserted and connected.

22. Cushioning insert as claimed in claim 21, wherein, in an area of heel loading, a cushioning insert of the honeycomb body has a flat bottom and a border area of the bottom extends upward in an arc-shape.

23. Cushioning insert as claimed in claim 1, wherein the heel shell and the honeycomb body have tongues which lie on top of one another and are joined securely to one another.

24. Cushioning insert as claimed in claim 23, wherein a lower of the tongues is narrower than an overlying one of the tongues.

25. Cushioning insert as claimed in claim 24, wherein a lateral surface of the overlying tongue which remains free of the narrower lower tongue, forms a means for attaching the insert to upper material of a shoe.

26. Cushioning insert as claimed in claim 1, wherein the heel shell has one of a peripheral support edge or groove in an area between a heel end cap and a bottom of the heel shell.

27. Shoe having an upper, an outer sole, an insole, and a cushioning insert attached in a heel area, wherein the cushioning insert is formed of a structural unit composed of a honeycomb body and a heel shell with a upwardly projecting peripheral heel cap the heel cap being connected to the shoe upper and being formed of one piece with the heel shell as a part thereof, wherein the honeycomb body is closed in a gas-tight manner by a portion of the heel shell, and wherein a bottom of the cushioning insert is matched to a contour of a top of the sole and is attached on it.

28. Shoe as claimed in claim 27, wherein the insole extends as far as a step of the cushioning insert and lies on a tongue on an end area of the insole, and wherein the insole is permanently joined to an adjacent tongue of the cushioning insert.

29. Shoe as claimed in claim 27, wherein the cushioning insert and the outer sole, at least in an area of a heel tread surface, are formed at least in part of at least one of a transparent, translucent, partially transparent or partially translucent material.

* * * * *